US005280752A

United States Patent [19]

Borgström et al.

[11] Patent Number: 5,280,752

[45] Date of Patent: Jan. 25, 1994

[54] SUB-COMBAT UNIT

[75] Inventors: Dan Borgström, Karlskoga; Lasse Karlsen, Lidingö; Lars Paulsson, Kristinehamn, all of Sweden

[73] Assignee: Bofors AB, Karlskoga, Sweden

[21] Appl. No.: 957,488

[22] Filed: Oct. 7, 1992

[51] Int. Cl.[5] ..... F42B 10/16; F42B 10/50

[52] U.S. Cl. ..... 102/384; 102/388; 244/3.27

[58] Field of Search ..... 244/3.27, 3.28, 3.29; 102/386, 388, 393, 489

[56] References Cited

U.S. PATENT DOCUMENTS

| | | | |
|---|---|---|---|
| H685 | 10/1967 | Olson et al. | 244/3.29 |
| 3,273,834 | 9/1966 | Bower | 102/388 |
| 4,858,532 | 8/1989 | Persson et al. | 102/387 |
| 4,890,554 | 1/1990 | Schleimonn-Jensen | 102/384 |
| 5,063,849 | 11/1991 | Axinger | 102/388 |
| 5,067,410 | 11/1991 | Mornone et al. | 102/489 |
| 5,088,414 | 2/1992 | Vesa | 102/388 |
| 5,155,294 | 10/1992 | Vesa | 102/387 |

FOREIGN PATENT DOCUMENTS

| | | |
|---|---|---|
| 0252036 | 3/1987 | European Pat. Off. . |
| 0424337 | 10/1990 | European Pat. Off. . |
| 0451123 | 3/1991 | European Pat. Off. . |

OTHER PUBLICATIONS

Weidner, R. T., et al., Elementary Classical Physics, (Mechanics, Kinetic Theory, Thermodynamics), vol. 1 (1965) pp. 308–317.

*Primary Examiner*—David H. Brown
*Attorney, Agent, or Firm*—Pollock, Vande Sande & Priddy

[57] ABSTRACT

The invention relates to a sub-combat unit which is disposed to be separated from a flying body, for example a carrier shell or the like, over a target area, the sub-combat unit comprising a warhead (4), a target detector (5) and two diametrically located carrier surfaces (1, 2) which impart to the sub-combat unit a rotation for scanning the target area in a helical pattern during the fall of the sub-combat unit down towards the target area, and both of the carrier surfaces (1, 2) being pivotally disposed from a collapsed position to an opened position where both of the carrier surfaces form a retarding area for the fall velocity of the sub-combat unit. The sub-combat unit is designed such that the relationship between the largest main inertia moment and the other main inertia moments of the sub-combat unit lies within the range of between 1.05 and 1.15. Hereby, the direction of the axis of rotation of the sub-combat unit will, during a transitional phase, be deflected and assume an almost vertical direction, at the same time as pendulum movements in the axis are damped out.

2 Claims, 1 Drawing Sheet

SUB-COMBAT UNIT

TECHNICAL FIELD

The present invention relates to a sub-combat unit disposed to be separated from flying body, for example a carrier shell or the like over a target area. The sub-combat unit comprises a warhead, a target detector and a device which imparts to the sub-combat unit a rotation for scanning the target area in a helical pattern during the fall of the sub-combat unit towards the target area. One such sub-combat unit has been previously described in Swedish patent specification 8601423-0 corresponding U.S. Pat. No. 4,858,532.

BACKGROUND ART

The characterizing features of the sub-combat unit described in the above-mentioned patent are that the target detector is pivotally disposed on a journal shaft which is parallel to the line of symmetry of the warhead so as to permit outward pivoting of the target detector from a closed position where the optical axis of the target detector coincides with the line of symmetry of the warhead, and to in opened position where the optical axis of the target detector is parallel to the line of symmetry of the warhead so as to permit a free view of the target detector beside the warhead, and that, and additional carrier surface is pivotally disposed on a journal shaft which is also parallel to the line of symmetry of the warhead as as to permit outward pivoting of the carrier surface from a closed position to an opened position beside the warhead.

By a suitable aerodynamic design of the sub-combat unit and the retarding area of the detector and carrier surface, there will be obtained a suitable fall velocity of the sub-combat unit and further an impelling moment about the spinning axis which gives the sub-combat unit its rotation. This is achieved without the aid of a parachute, which is an advantage since the parachute is bulky and requires space. Within the available space in a carrier shell, more space can instead be made available for the warhead proper.

Even if the above-described sub-combat unit has proved to possess superior properties in respect of fall velocity and scanning rotation, wishes have been voiced in the art to be able to increase the retarding area even further. This may, for instance, be the case when it is desired to employ heavier warheads. The retarding area of the target detector and carrier surface is restricted to the cross-sectional area of the cylindrical sub-combat unit body, which may entail that the fall velocity will become too high with the existing size of the retarding area if, at the same time, the weight of the warhead is increased.

Swedish patent application number 8903474-8 corresponding to U.S. Pat. No. 5,088,414, describes a sub-combat unit in which the retarding area has been made considerably larger. The characterizing feature of the sub-combat unit is that two diametrically located carrier surfaces are pivotally disposed each on then shaft located in a plane which is at light angles to the axis of symmetry of the warhead, from a closed position where the carrier surfaces follow the casing surface of the sub-combat unit, to a 90 degrees opened position where both of the carrier surfaces form a retarding area for the fall velocity of the sub-combat unit.

In this case, the carrier surfaces are made of an elastically flexible material, so that, when they pivot out from then closed position, they are at the same time bent to a substantially straight oi gently curved surface.

The advantage inherent in the above-described design, in addition to the larger retarding area, is that both of the carrier surfaces may be made comparatively thin, which is favorable from the point of view of weight and payload. For example, the carrier surfaces may be made of titanium and bent so that, in then opened position, they have a certain radius. The bending may be varied and the carrier surfaces may be of different lengths, in which event further parameters for varying the aeronautical properties of the unit will be obtained.

The sub-combat units are disposed to be separated from a missile, a carrier shell or other flying platform, for example a canister which in its turn has been separated from a carrier shell or missile, for example a 15.5 cm artillery shell.

In order that the sub-combat unit in its functional phase (the scanning phase) operate in the intended manner, it is necessary that the axis of rotation is close to vertical and that the pendulum movements of the axes are slight, with an amplitude of at most a few degrees. By designing the two carrier surfaces with accurately indicated geometry and by providing them with means for completely relieved (turbulent) flow, see our copending patent application Ser. No. 07/957,487, filed Oct. 7, 1992, pendulum motion and instabilities can be reduced to a minimum and a predetermined rotation, fall velocity and orientation can be maintained during the scanning phase.

When the sub-combat units are fast separated from the shell and subsequently from the canister, the flying state of the sub-combat units is, however, highly varied, depending upon discharge descent, different from the described state, i.e. a state in which the axis of rotation is near to vertical as is to apply during the scanning phase.

In most cases, the carrier (for example an artillery shell, missile or canister) will, on discharge of the sub-combat units, have a trajectory which may be as good as horizontal. On discharge, the sub-combat unit will begin to rotate about its major main inertia axis, at the same time as this axis will begin to oscillate. The major direction of the axis will, however, be largely parallel to the trajectory tangent of the carrier prior to separation.

OBJECTS OF THE INVENTION

The object of the present invention is to obviate the problem inherent in causing the direction of the axis of rotation of the sub-combat unit to be deflected to as good as vertical, at the same time as the pendulum motion of the axis is damped, i.e. changing the orientation of the sub-combat unit into the prescribed state.

SOLUTION

This problem is solved according to the present invention by causing the ratio between the largest main inertia moment and the other main inertia moments of the sub-combat unit to lie within the range of between 1.05 to 1.15. A value of lower than 1.05 means that the pendulum motion or oscillation of the axis of rotation is damped too slowly, a value higher than 1.15 implies that the deflection of the axis to almost vertical position will take too long a time, i.e. will require too long a trajectory length.

The moment is developed as a result of the angle of entry or angle of attack and the angle of wind impingement on the sub-combat unit. In addition to modifying the orientation of the sub-combat unit, the moment also damps oscillations in the sub-combat unit, so that stationary flying state with small oscillation amplitudes is achieved at the beginning of the scanning phase. In stationary a flight state, the aerodynamic moments are slight on the sub-combat unit.

BRIEF DESCRIPTION OF THE ACCOMPANYING DRAWINGS

The present invention will be described in greater detail hereinbelow with particular reference to the accompanying drawings which, in FIGS. 1, 2 and 3 show the sub-combat unit with main inertia axis marked, and in different positions.

DESCRIPTION OF PREFERRED EMBODIMENT

Figure 1:
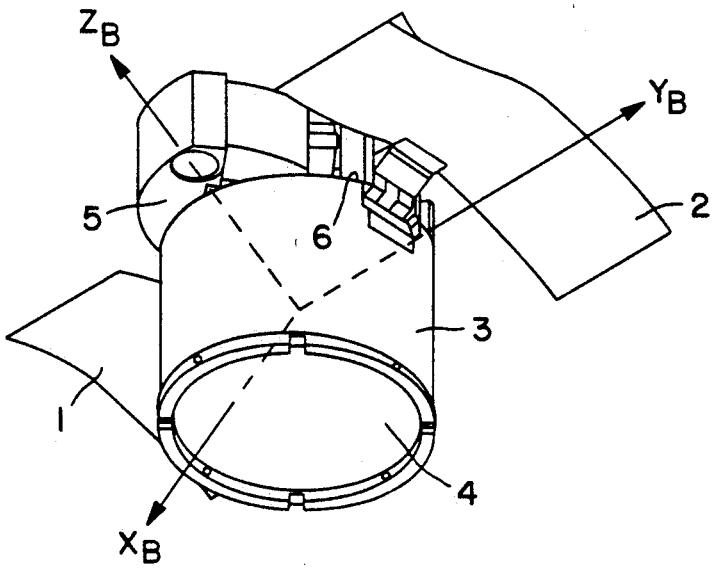

Those sub-combat units which are described here are disposed in an artillery shell which is discharged by means of a 155 mm howitzer in a ballistic trajectory towards the target area. The artillery shell may, for instance carry two sub-combat units. When the shell arrives at the target area, the sub-combat units are separated from the shell and, during a transitional phase, the sub-combat units are to be set in a pre-determined rotation, fall velocity and orientation at the beginning of the scanning phase.

In the first stage of the transitional phase, the sub-combat units are enclosed in a cylindrical canister which is fitted with brake fins in order to deduce the rotation of the sub-combat units. After separation from the canister, two diametrically located carrier surfaces 1, 2 on the sub-combat unit ale activated, the two carrier surfaces being pivotally disposed from a collapsed position where the carrier surfaces follow the casing surface 3 of the sub-combat unit, and to an opened position where both of the retarding surfaces form a retarding area.

The sub-combat unit comprises a warhead 4 and a target detector 5 which is displaced from a collapsed position in a stirrup-like superstructure 6 on the warhead to an opened position where it has a free view beside the warhead.

When the prescribed flying state of the sub-combat unit has been achieved, i.e. predetermined rotation, fall velocity and orientation, and additional conditions such as prescribed altitude over the target area have been achieved, the detector is activated and the scanning phase begins. The detector scans the target area in a helical pattern, similar to the groove in a gramophone record, during the fall of the sub-combat unit down towards the target area. When a target is detected, a SAF (safety, aiming and firing unit) is initiated which triggers the warhead 4. A directed explosive projectile is discharged with high kinetic energy towards the target, for example the turret roof on a tank.

The carrier surfaces, detector and warhead proper are of per se known type and will not, therefore, be described in greater detail here.

As was mentioned by way of introduction, the sub-combat unit will, after the separation, begin to rotate about its major main inertia axis. It is important that a sufficient aerodynamic moment is created so that oscillations in the sub-combat unit are dampened and that the orientation of the main inertia axis is modified to almost vertical. According to the present invention, this is achieved by causing the moment of inertia to maintain a ratio in a given manner. The ratio between the largest main inertia moment, i.e. the moment of inertia of the main inertia axis and the other main inertia moments must be about 1:1.

The co-ordinate system XYZ (see figure) of the sub-combat unit coincides with the main inertia axis, with the largest inertia moment on the X axis and the other main inertia axis on the z and Y axes which make an angle of 90 degrees with the X axis. In its turn, the X axis makes an angle of 30 degrees with the line of symmetry of the warhead. During the scanning phase, the rotation vector of the sub-combat until must coincide with the X axis.

If the rotation vector does not have the same direction as the main inertia axis (the X axis), the aerodynamic dampening must be sufficiently great such that both directions are caused to coincide before the beginning of the scanning phase, i.e., any possible oscillations in the sub-combat unit are dampened out.

The aerodynamic carrier surfaces 1, 2 develop moments in suitable directions in order, together with gyration forces of the rotating sub-combat unit, to modify the orientation to the prescribed state, i.e. that the orientation of the main inertia axis, the x axis, will be close to vertical. In order to modify the orientation within the prescribed time, the relationship between the main inertia moment must lie within the range of between 1.05 and 1.15, preferably about 1.1. If the main inertia moment is of such relationship, a sufficiently rapid modification will be obtained of the orientation of the sub-combat unit, at the same time as a sufficient dampening of oscillations in the sub-combat unit will be obtained.

Figure 2:
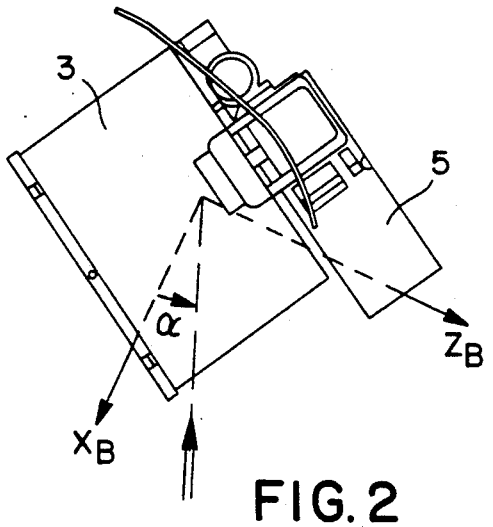

In the foregoing, we have emphasized the importance that a sufficient aerodynamic moment is created so that oscillations in the sub-combat unit are dampened out. This also implies that the rotation dampening must have a positive derivative of sufficient magnitude in order that a predetermined rotation can be imparted to the sub-combat unit when the velocity varies. In increasing angle of entry or angle of attack $\alpha$, see FIG. 2, it is important that the rotation modifications are slight. The reason for this is that an increase in the rotation speed could cause the sub-combat unit to be gyro-stabilized, in which event the change in the direction of the largest main inertia axis towards the prescribed vertical direction will take too long time or will not occur at all if the speed of rotation becomes much too great.

Figure 3:
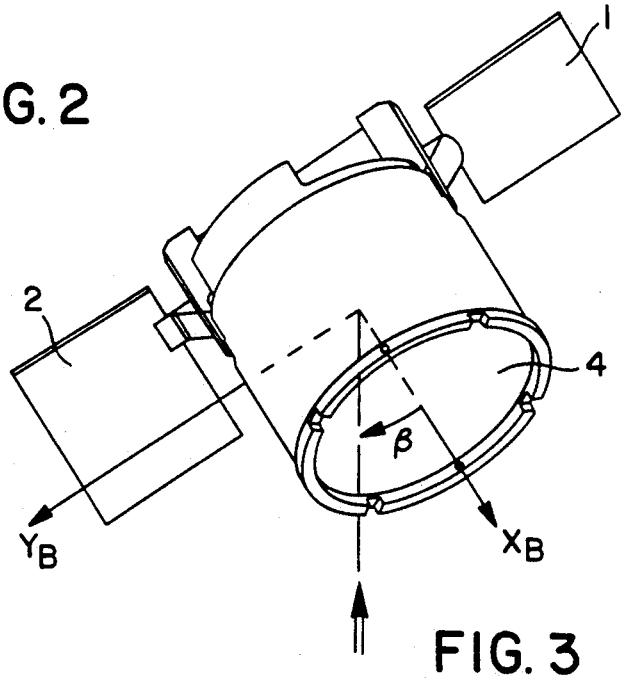

In order that the prescribed flying state occur, i.e. almost vertical rotation axis (main inertia axis), it is also necessary that the pitching moment fades with increased angle of attack $\alpha$, but increases with increased slide slip angle $\beta$, see FIG. 3. The yawing moment must increase with both increased angle of attack a and increased slide slip angle $\beta$.

What we claim and desire to secure by Letters Patent is:

1. A sub-combat unit disposed to be separated from a flying body, over a target area, the sub-combat unit comprising a warhead, a target detector and two diametrically located carrier surfaces (1, 2) which impart to the sub-combat unit a rotation for scanning the target area in a helical pattern during the fall of the sub-combat unit down towards the target area, and both of the carrier surfaces being pivotally disposed from a collapsed position to an opened position in which both of the carrier surfaces from a retarding area for the fall velocity of the sub-combat unit, characterized in that the relationship between the largest main inertia moment and the other main inertia moments of the sub-combat unit lies in the range of between 1.05 and 1.15.

2. The sub-combat unit of claim 1 wherein said relationship is 1.1.

* * * * *